US007007910B1

(12) United States Patent
Krinner et al.

(10) Patent No.: US 7,007,910 B1
(45) Date of Patent: Mar. 7, 2006

(54) DEVICE FOR FASTENING POLES, POSTS, MASTS OR THE LIKE IN THE GROUND, AND METHOD FOR MANUFACTURING A FASTENING DEVICE

(75) Inventors: Klaus Krinner, Blumenthal 19, 94342, Strasskirchen (DE); Guenther Thurner, Strasskirchen (DE)

(73) Assignee: Klaus Krinner, Strasskirchen (DE)

( * ) Notice: Subject to any disclaimer, the term of this patent is extended or adjusted under 35 U.S.C. 154(b) by 0 days.

(21) Appl. No.: 09/762,713

(22) PCT Filed: Aug. 6, 1999

(86) PCT No.: PCT/EP99/05705

§ 371 (c)(1),
(2), (4) Date: Mar. 8, 2001

(87) PCT Pub. No.: WO00/09833

PCT Pub. Date: Feb. 24, 2000

(30) Foreign Application Priority Data

Aug. 11, 1998 (DE) ..... 198 36 370

(51) Int. Cl.
*F16M 13/00* (2006.01)

(52) U.S. Cl. ..... 248/530; 52/165; 248/156; 248/545; 405/244

(58) Field of Classification Search ..... 248/530, 248/545, 546, 156; 52/157, 155, 165, 736.4; 72/402; 405/244, 232
See application file for complete search history.

(56) References Cited

U.S. PATENT DOCUMENTS

| | | | | |
|---|---|---|---|---|
| 2,103,948 | A * | 12/1937 | Jones | 248/530 |
| 2,441,109 | A * | 5/1948 | Carlson | 248/156 X |
| 4,290,712 | A | 9/1981 | Hayes | |
| 4,795,137 | A | 1/1989 | Witt | |
| 4,832,304 | A * | 5/1989 | Morgulis | 248/533 |
| 4,852,380 | A * | 8/1989 | Haldric et al. | 72/402 |
| 5,358,209 | A * | 10/1994 | Ward | 248/545 |
| 5,457,918 | A * | 10/1995 | Plourde | 52/165 |
| 5,524,855 | A * | 6/1996 | Lesar | 248/530 |
| 5,881,495 | A * | 3/1999 | Clark | 47/48.5 |
| 6,032,880 | A * | 3/2000 | Verrills et al. | 248/530 |
| 6,234,444 | B1 * | 5/2001 | Haddad | 248/545 |
| 6,299,125 | B1 * | 10/2001 | Zayeratabat | 248/530 |
| 6,494,643 | B1 * | 12/2002 | Thurner | 405/244 |

FOREIGN PATENT DOCUMENTS

DE 29 24 432 4/1980

(Continued)

*Primary Examiner*—Anita King
*Assistant Examiner*—Tan Le
(74) *Attorney, Agent, or Firm*—Jordan and Hamburg LLP

(57) ABSTRACT

A method for manufacturing a device for fastening poles, posts, masts or the like in the ground and a fastening device with a basic body are described, it being possible, but not essential, for at least one part portion of the basic body to be provided with a screw-like or spiral-like thread, and the basic body essentially having a cone-shaped basic shape with at least one conical part portion. According to the method of the present invention, the basic body is hammered into the basic shape from an essentially cylindrical tube. The fastening device has a holding portion, and an anchoring portion designed in one piece which, if provided with a thread, has at least two part portions of different conicity. The holding portion and essentially the anchoring portion are hollow throughout.

6 Claims, 3 Drawing Sheets

FOREIGN PATENT DOCUMENTS

| | | |
|---|---|---|
| DE | 9313258 | 3/1994 |
| DE | 9416433 | 12/1994 |
| DE | 295 12 237 | 11/1995 |
| DE | 297 12 900 | 11/1997 |
| DE | 19624738 | 1/1998 |
| DE | 196 37 985 | 3/1998 |
| EP | 0590367 | 4/1994 |
| GB | 2068037 | 8/1981 |

* cited by examiner

DEVICE FOR FASTENING POLES, POSTS, MASTS OR THE LIKE IN THE GROUND, AND METHOD FOR MANUFACTURING A FASTENING DEVICE

BACKGROUND OF THE INVENTION

The present invention relates to a device for fastening poles, posts, masts or the like in the ground and a method for manufacturing a fastening device.

Fastening devices for poles, posts, masts or the like for driving or screwing into the ground are in most cases manufactured by metal casting or welding together individual prefabricated shaped parts. In this connection, the manufacture of parts by casting or milling is relatively complicated and costly, and the manufacture of shaped parts does not allow 100% utilization of the starting material, which likewise contributes to increasing the cost of manufacture. In addition, the joints, at which the individual shaped parts are welded, adhesively bonded or pressed together, may bring about a weakening of the stability of the basic bodies of the corresponding fastening devices.

A fastening device is known from German Utility Model 93 13 258.1. This has a threaded portion, which can be screwed into the ground and out of it again, and a holding portion for receiving the pole, post, mast or the like. A cone-shaped displacement body for the earth material, which is active when the fastening device is screwed in, is arranged between the threaded portion and the holding portion. The threaded portion is a cast part and bears a spiral-shaped thread. The adjacent displacement body is shaped like a truncated circular cone and is essentially hollow and is, on the side of its smaller diameter, welded to the essentially cylindrical or slightly conical solid core of the threaded portion. The cone angle of the truncated circular cone-shaped displacement body is in this case distinctly greater than the angle of the threaded portion. The threaded portion and the displacement body form the anchoring portion of the fastening device.

As the fastening device, and in particular the anchoring portion, according to German Utility Model 93 13 258.1, is made up of a number of parts welded together, problems of strength may arise in particular in the region of the connection between the threaded portion and the displacement portion during screwing-in and out or in the event of forces acting on the fastening device. Moreover, the threaded portion of the anchoring portion, which is in the form of a cast part with a solid core, requires the use of a great deal of material.

Another fastening device is described in German patent specification 40 02 830. This fastening device has a threaded portion which can be screwed into the ground and out of it again and, at its rear end seen in the screwing-in direction, a holding portion for receiving the pole, post or the like is provided. The threaded portion, which is designed as the anchoring portion, is of corkscrew-like or screw-like design and has a conical core which tapers steeply in the screwing-in direction. The relatively obtuse cone angle, which remains constant over the entire anchoring portion, makes screwing the fastening device into the ground more difficult on account of radial forces which arise, and, owing to the cone shape, does not allow secure anchoring of the fastening device in the ground because forces, such as those caused by shaking movements, arising radially on account of the obtuse cone angle, lead to the anchoring portion being loosened from the ground.

The fastening device according to German patent specification 40 02 830 consists of plastic material, which requires manufacture by laminating, hot-forming, injection moulding etc. These processes are relatively cost-intensive and thus expensive on account of necessary preliminary work. While it is true that an anchoring portion manufactured in this way does not have any stability-reducing joints, it nevertheless has to be made from solid material in order to achieve the stability required.

SUMMARY OF THE INVENTION

The object of the present invention is therefore to provide a fastening device for poles, posts, masts or the like for driving or screwing into the ground, which, essentially under all conditions and with the use of as little material as possible, affords great stability and thus allows secure anchoring in the ground and also affords safe and easy handling during driving-in or screwing into and out of the ground. Another object of the present invention is to provide a method for manufacturing such a fastening device for fastening poles, posts, masts or the like in the ground, in particular for manufacturing a ground peg with a basic body, which method is inexpensive in the manufacture of the basic body of the fastening device and requires the use of a small amount of material.

The present invention includes a method for manufacturing a device for fastening poles, posts, masts or the like in the ground, in particular a ground peg, and in particular to manufacture a fastening device according to the present invention having a basic body which optionally includes at least one part portion provided with a screw-like or spiral-like thread, and has substantially a cone-shaped basic shape with at least one conical part portion. The method includes the basic body being hammered, forged or worked into the basic shape from an essentially cylindrical tube. If desired, the screw-shaped or spiral-shaped thread can then be attached to the basic body at least in one part portion, in particular by welding on a correspondingly prefabricated shaped part. The basic shape of the basic body can be designed in an essentially acute-angled and cone-shaped manner as an anchoring portion, which makes possible easy driving-in or screwing-in.

The hammering into shape of an essentially cylindrical tube to manufacture the basic body of the fastening device according to the present invention affords an advantage that the deforming forces acting on the cylindrical tube are introduced into the tube both axially and radially by shaping hammer parts running axially around the tube, as a result of which relatively great deformation of the tube can be achieved. In contrast, when the tube is pressed into shape by axial pressing-in in a die, only axial forces act on the tube, by means of which the tube could be upset. The tube-hammering method according to the present invention for cone-shaped basic shapes of the basic body of the fastening device is consequently particularly reliable and safe.

The tube-hammering method as such is known for other purposes and will therefore not be described in greater detail below. Other suitable methods with similar force action on the tube are also possible, in particular forging, working or the like, for manufacturing the basic shape of a ground peg. In this connection, the tube can additionally be partly heated in order to facilitate deformation. Using these methods, tubes can theoretically be deformed into a tip. This is also possible in the manufacture according to the present invention of fastening devices. In particular, using this method, it is especially possible to form the desired essentially cone-shaped basic shape which is in particular acute-angled.

As the method according to the present invention for manufacturing the fastening device is a non-cutting method, virtually 100% utilization of starting material used, that is to say of the essentially cylindrical tube used, is achieved. By deforming the tube into an essentially cone-shaped basic shape, the hammering operation causes the wall thickness to increase with a smaller diameter of the basic body, while the cavity in the tube is essentially preserved. In addition to the fact that the basic body, in particular the anchoring portion, can be essentially hollow-formed as a unit, that is to say in particular in one piece, enlargement of a wall thickness is especially advantageous because the stability of the basic body and thus of the fastening device which can be achieved is consequently greater than in the case of fastening devices which have to be assembled and welded together from a number of individual parts.

Another advantage is that the method is less labour-intensive and is thus cost-effective because of the absence of any jointing or assembly steps.

In the method for manufacturing a basic body of the fastening device, it is especially advantageous to form the basic body in one piece with a holding portion and an anchoring portion. This results in further strengthened stability of the whole fastening device.

In another preferred embodiment of the method for manufacturing the basic body of the fastening device, it is advantageous to design the basic shape of the basic body as a one-piece anchoring portion and to attach, in particular to weld on, thereto the holding portion. The holding portion is substantially in the form of a sleeve and is manufactured by means of a tube-end pressing method. Any other suitable connection technique is likewise possible. The attachment of an initially separately manufactured holding portion part allows greater flexibility in the design of the fastening device, for example, in consideration of different insertion parts for the holding portion.

In another preferred embodiment of the present invention, it is especially advantageous that the basic body, with the anchoring portion and holding portion, is substantially hollow throughout. A result of the hollow body is that the manufacturing costs can be further reduced on account of the saving of material, and the weight of the basic body also remains low.

In an especially preferred embodiment of the method for manufacturing the fastening device, the basic body is provided with a bore through its wall at least in a lower, first part portion seen in the direction of insertion into the ground. Through this bore, which communicates in particular with the essentially hollow anchoring portion, any standing water in the fastening device can drain off relatively easily. A resulting high water column above the bore builds up a relatively high water pressure and a deep position of the bore in the ground means that gravelly soil may already be reached, which allows water to seep away more readily than the humus at the surface. It may perhaps even be appropriate to moisten the ground during the driving-in or screwing-in operation by means of water which is introduced into the anchoring portion from above and can then escape via the bore. This can further ease driving-in or screwing-in, in addition to the cone shape of the anchoring portion, which is optimized according to the present invention.

Especially advantageous is an embodiment of the method, in which the essentially cylindrical tube is reduced to a diameter of roughly 10 mm, and a square tip is attached, in particular pressed on, to this cylindrical piece. the tip is especially advantageous because it has great stability during driving-in or screwing-in and displaces small stones and hard layers of earth especially well. Conically shaped tips or cutting-tool tips or drill bits are also possible.

In an advantageous embodiment of the method, in the event that no thread is provided, at least one fin-like surface element is attached in a suitable manner, in particular welded on, to the basic body essentially in its longitudinal direction. Especially advantageous is the attachment of three or four fin-like surface elements spaced equiangularly over the circumference. The surface elements can be stamped, cast, milled or manufactured in another suitable manner. By attaching the surface element(s), additional stability and good guidance can be achieved, in particular when the fastening device is driven in.

The fastening device according to the present invention with the basic body, which can be manufactured in particular by means of the method described above, has the anchoring portion for anchoring in the ground and the holding portion for receiving the pole, post, mast or the like. The anchoring portion is designed as a cone-shaped, essentially acute-angled displacement body which has at least one cone-shaped part portion. There may also be two, three or four part portions of different conicity. At least one part portion of the displacement body can bear a screw-shaped or spiral-shaped thread for screwing into the ground and out of it again, but this is not essential. If the fastening device is intended for driving into the ground, the thread is omitted. The first cone-shaped part portion of the displacement body in the direction of insertion into the ground has a more acute cone angle than the second cone-shaped part portion following it. Any further following portions can have any cone angle, small or large. According to the present invention, the anchoring portion is formed in one piece from a hollow blank, in particular from an essentially cylindrical tube. Furthermore, according to the present invention, the holding portion and essentially the anchoring portion are hollow throughout.

A suitable material for the fastening device according to the present invention is in particular metal, in particular with appropriate anti-corrosion treatment.

The anchoring portion is preferably closed on the first portion in the direction of insertion into the ground. The closure can be brought about by compression of the material of the essentially cylindrical tube.

According to the present invention, the anchoring portion and the holding portion are essentially hollow throughout, which, in addition to a saving in terms of material and thus cost and reduced weight, also results in the advantage that the holding portion and the anchoring portion or displacement body can serve to receive the ground end of a pole, post or the like to be erected using the fastening device. The ground end of this pole or post or the like undergoes positional fixing, in particular in the horizontal plane by means of the essentially acute-angled conical inner surface of the portions or part regions of the portions, and clamping in a self-locking manner by the radially acting forces.

As the anchoring portion is designed essentially over its entire length as a cone-shaped, essentially acute-angled displacement body for the earth material, the fastening device is braced in the ground during driving or screwing into the latter, as earth material and stones are displaced according to the essentially acute displacement body angle over the entire cone length. As a result of this, the forces displacing the earth material and any stones are greater than in fastening devices which displace the earth material essentially only in a relatively obtuse-angled displacement body region between a threaded portion and the holding portion. Consequently, driving-in or screwing-in is made easier. The advantage over a cone angle which remains constant throughout over the entire anchoring portion is that a smaller cone angle makes the placing and alignment of the fastening device in the ground easier at the start of screwing-in and keeps the effort required during driving-in or screwing-in low.

As, according to the present invention, at least the anchoring portion is formed in one piece from a blank, and there are consequently no joints between different component parts in this region. Improved stability of the anchoring portion and of the fastening device is achieved in comparison with the prior art.

It is especially advantageous if the anchoring portion and the holding portion are formed in one piece so as to increase further the stability of the whole device.

In another embodiment of the fastening device, the holding portion is attached, in particular welded on, as a shaped part as described further above to the anchoring portion. Any other suitable connection technique is likewise possible. The essentially sleeve-shaped holding portion can then be adapted especially well to different sizes of poles, posts, masts or the like to be inserted. Such an essentially sleeve-shaped holding portion advantageously includes five portions. A first portion forms a cone for centring in the anchoring portion of the basic body formed into the basic shape. A second portion is designed as a hexagon for transmission, if appropriate, of a rotary movement by means of a hexagon socket screw key. A third portion is designed as a cylindrical portion and establishes the distance between the first portion and the top portion of the anchoring portion. A fourth portion affords the possibility of receiving any fixing and positioning aids in the holding portion, and a fifth portion offers the possibility of clamping the poles, posts, masts to be fastened or positioning and fixing devices in the holding portion.

In general, the fastening device according to the present invention, or the basic body manufactured according to the present invention, offers the possibility of allowing, in the holding portion, fixing of the objects to be fastened or of the optionally additionally used positioning devices.

In a preferred embodiment of the fastening device according to the present invention, the at least two part portions of the anchoring portion have a small difference in cone angle in the range of 1 to 3 degrees. Any differences in the cone angle between other part portions can have the same angular range but can also be greater.

According to the present invention, a thread is arranged in such a manner that at least one part portion of the anchoring portion or of the displacement body bears a screw-shaped or spiral-shaped thread.

However, it is especially preferred if the thread extends essentially over the entire length of the anchoring portion. The thread can then extend over all or some of the individual cone-shaped portions. The thread is attached, in particular welded on, as a shaped part to the basic shape of the basic body of the anchoring portion.

The drawing-in forces of the corresponding thread are then defined by the size of the active surface on the thread turn. As the whole anchoring portion is of cone-shaped design, that is to say as the diameter of the thread-bearing regions of the anchoring portion increases, the thread diameter and thus the active surface on the thread turn also increase. After screwing of the threaded portion into the ground has been completed, two opposite forces act in the whole fastening device seen in the axial direction. Namely, a force built up by the threaded portion, which force acts so as to draw the fastening device still further into the ground, and an opposite force built up by the anchoring portion through the compacted earth material act on the fastening device. These two forces acting in opposite directions brace the fastening device or its anchoring portion in the ground.

As a result of the essentially acute-angled design of the anchoring portion or of the displacement body and the small cone angle differences preferred according to the present invention between the at least two part regions of different conicity, not only is driving-in or screwing-in made easier, but, on account of the uniform compaction over the entire length, secure fixing of the fastening device is also achieved. This can be used optimally in particular with the thread extending essentially over the entire length of the anchoring portion.

In an advantageous embodiment of the fastening device, in the event that no thread is provided, at least one fin-like surface element is attached in a suitable manner, in particular welded on, to the smooth basic body essentially in its longitudinal direction. Especially advantageous is the attachment of three or four fin-like surface elements spaced equiangularly over the circumference. The fin-like surface elements extend at least over one part portion of the anchoring portion and project essentially radially from the basic body. Surface elements which are non-planar and/or arranged at a radial and/or axial angle are also possible at least in part regions.

By attaching the fin-like surface element(s), additional stability can be achieved, in particular when the fastening device is driven in. They also provide improved directional guidance during driving-in. As the active lateral surface of the anchoring portion in the ground is enlarged by the fin-like surface elements, the fastening device can take up and dissipate greater lateral forces. This offers in particular additional protection against twisting.

In another preferred embodiment of the present invention, the essentially hollow anchoring portion has a bore in its lower part portion, in the first cone-shaped part portion in the direction of insertion into the ground. The water exchange with deeper ground layers already described above is possible via this bore through the wall of the anchoring portion.

In the case of the fastening device with the thread for screwing into the ground, it is preferred to provide on the anchoring portion or the displacement body and/or on the holding portion at least one point of application for a tool for applying the screwing movement to the threaded portion. In an especially preferred embodiment, the point of application is formed by two bores, which are offset by 180 in relation to one another and lie essentially in a horizontal plane, for receiving a turning handle. Accordingly, in order to screw the fastening device according to the present invention, or its anchoring or threaded portion, into the ground, all that is necessary is to guide a handle. For example an appropriately dimensioned bar or the like, through the two aligned bores, after which this bar can be used to increase the torque to be applied to the threaded portion could be used.

In the case of the fastening device without the thread for driving-in, it may likewise be preferred if the device has the bores described above. This makes it possible for a handle, for example an appropriately dimensioned bar or the like, to be guided through the two aligned bores, after which this bar serves for pushing-in and/or to support the driving of the fastening device into the ground.

BRIEF DESCRIPTION OF THE DRAWINGS

The present invention is described in greater detail below with reference to exemplary embodiments shown in the appended drawings, in which.

DETAILED DESCRIPTION OF THE INVENTION

Figure 1:
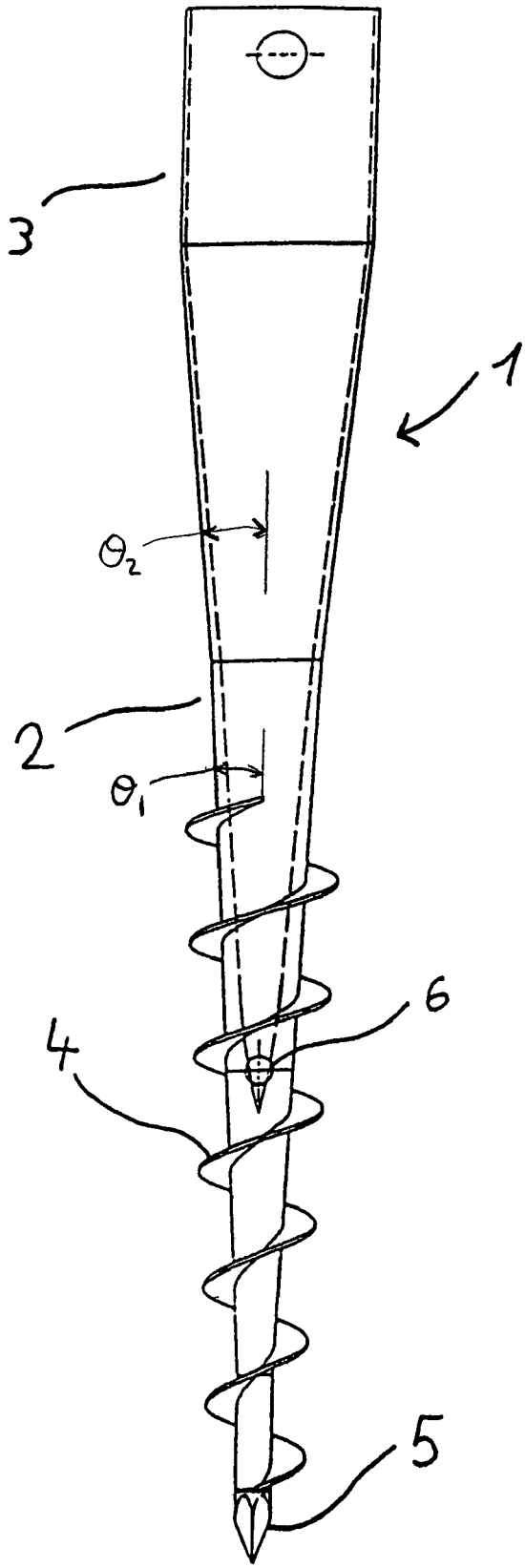
FIG. 1 shows a side view of a first preferred embodiment with a thread of the fastening device according to the present invention.
Figure 2:
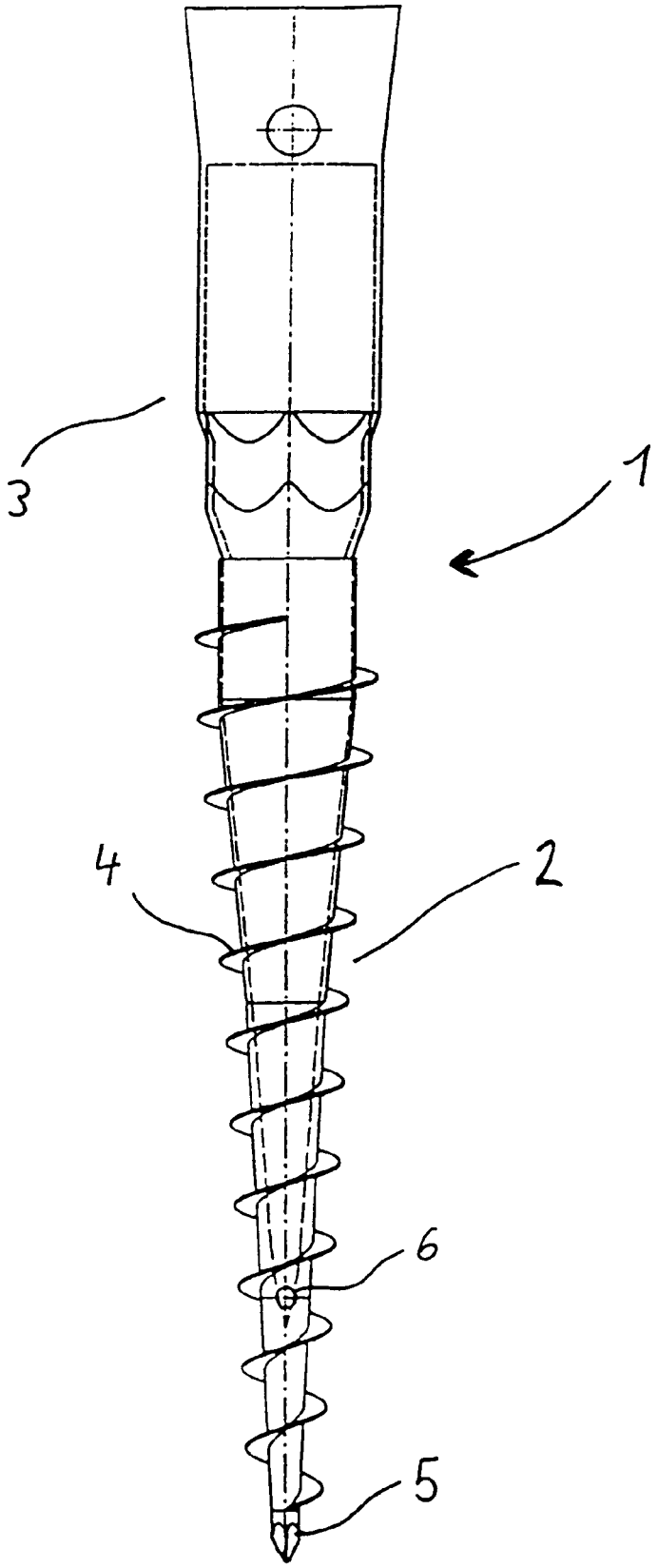
FIG. 2 shows a side view of a second preferred embodiment with a thread of the fastening device according to the present invention.

FIGS. 1 and 2 show two preferred embodiments of the fastening device according to the present invention with a thread for screwing into the ground and out of it again. All details relating to these two figures, with the exception of those which concern the thread, can also apply for the fastening devices according to the present invention without a thread for driving into the ground.

FIG. 1 shows a first preferred embodiment of the fastening device according to the present invention with a thread.

The fastening device has a basic body 1 with an anchoring portion 2 and a holding portion 3, the anchoring portion 2 and the holding portion 3 being formed in one piece. The anchoring portion 2 is designed as an essentially acute-angled displacement body and is divided into two part portions of different conicity. The first cone-shaped part portion in the screwing-in direction having a more acute cone angle θ1 than the cone angle θ2 of the second conical part portion in the screwing-in direction. The first conical part portion bears a thread 4. A tip 5 is applied to the first conical part portion. Moreover, the first cone-shaped part portion has a bore 6 which extends through the wall of the basic body cavity of the essentially hollow basic body 1.

According to the present invention, the two cone-shaped part portions of the basic body are hammered into its cone-shaped basic shape from an essentially cylindrical tube.

The holding portion has two bores (one of these can be seen in FIG. 1) which serve to receive a turning handle for screwing the fastening device into the ground.

FIG. 2 shows a second preferred embodiment of the fastening device according to the present invention with a thread, or of the basic body of the fastening device according to the present invention with a thread.

The basic body 1 of the fastening device is designed as an anchoring portion which has been hammered into the basic shape. The anchoring portion 2 has two part portions of different conicity, the lower cone-shaped part portion, the first in the screwing-in direction, having a more acute cone angle than the second conical part portion in the screwing-in direction. In this embodiment, the thread 4 extends over both cone-shaped part portions. An essentially sleeve-shaped holding portion 3 manufactured by means of a tube-end pressing method is attached, or welded on, to the basic shape of the basic body, which is designed as the anchoring portion 2. The basic body 1 thus formed is essentially hollow. The hollow interior is (in the other drawings also) indicated by the dashed lines. Located in the lower region of the basic body 1 is a bore 6 which extends through the wall of the basic body 1 to the hollow inner region of the basic body 1. Pressed onto the first conical part region, in the screwing-in direction, of the anchoring portion of the basic body, which is designed as a displacement body, is a square tip 5. The holding region 3 is divided into five portions: a first cone-shaped portion for centring and fastening in the anchoring portion, a second hexagonal portion for transmission of a rotary movement by means of a hexagonal socket screw key in order thus, for example, to screw the fastening device into and out of the ground, a third cylindrical portion, a fourth conical portion for receiving any required or desired positioning and fixing devices in the holding portion 3, and a fifth portion which can serve for clamping the objects to be fixed.

The essentially sleeve-shaped holding portion 3 is manufactured by means of an essentially known tube-end pressing method.

Figure 3A:
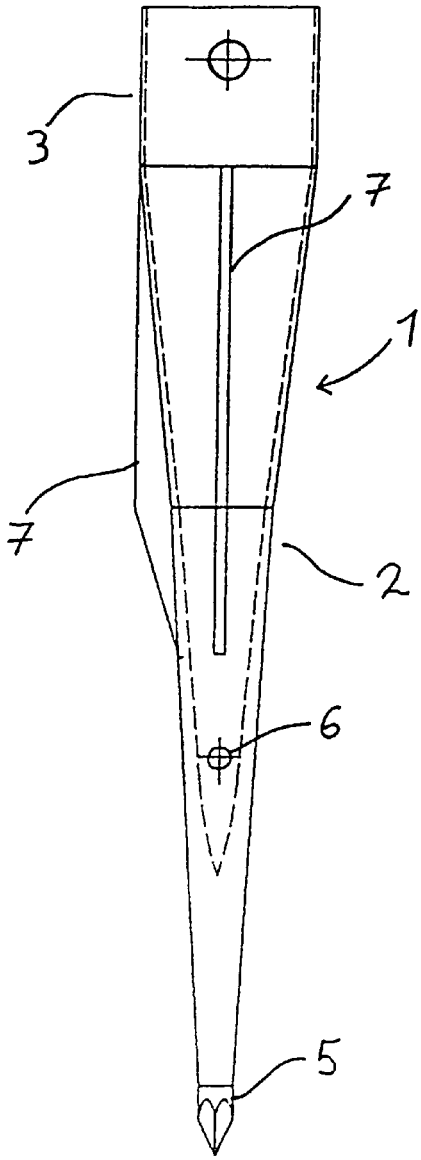
FIG. 3*a* shows a side view of a preferred embodiment without a thread of the fastening device according to the present invention.

FIG. 3*a* shows a preferred embodiment of the fastening device without a thread.

The basic body 1 is formed in one piece with an anchoring portion 2 and a holding portion 3. In this case, it has no thread. The anchoring portion 2 has two regions of different conicity. However, a different number of part portions, but at least one conical part portion, can be present. Pressed onto the lower portion, the first in the direction of driving into the ground, is a square tip 5.

The anchoring portion 2 and the holding portion 3 are hammered from a tube so as to be essentially hollow throughout. The bottom portion of the anchoring portion is compressed by hammering to such an extent that it no longer has a hollow interior. In the lower portion, at a suitable height, the holding portion has a bore 6 which extends through the wall of the basic body 1 to its hollow interior. Two fin-like surface elements 7 are attached to the outer surface of the anchoring portion 2 in its longitudinal direction. These elements extend essentially radially away from the anchoring portion and, on their side facing the anchoring portion, follow the contour of the cone-shaped portions. The surface elements do not extend as far as the tip 5 or as far as the bottom portion of the anchoring body. However, this is also possible. The surface shape of the surface elements 7, or the contour of their narrow sides facing away from the anchoring portion, is optional. However, the area is limited by the fact that the ease of handling of the fastening device is to remain guaranteed, in particular during placing and driving-in. Variation of the surface shape and/or of the area allows adaptation to different types of use, types of ground and force action, and in particular optimum protection against twisting of the fastening device.

Figure 3B:
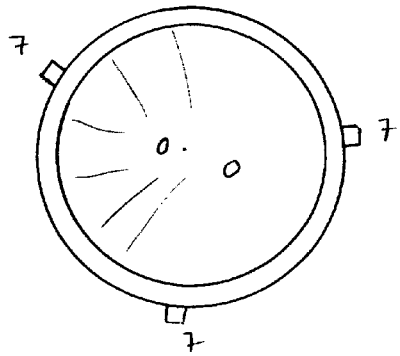
FIGS. 3*b* and 3*c* show top views of a preferred embodiment without a thread of the fastening device according to the present invention.
Figure 3C:
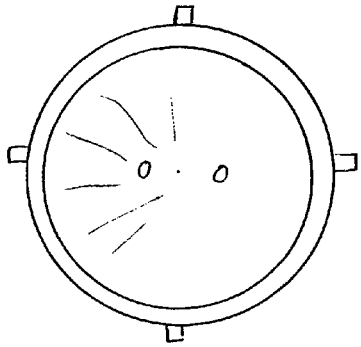

FIG. 3*b* shows a top view of three fin-like surface elements 7 attached to the outer surface of the anchoring portion 2. FIG. 3*c* shows a top view of four fin-like surface elements 7 attached to the outer surface of the anchoring portion 2.

The invention claimed is:

1. A device for fastening an object in the ground, comprising:

a basic body;

said basic body having an anchoring portion for anchoring the basic body in the ground and a holding portion for engaging the object, said anchoring portion and said holding portion being respectively positioned along a longitudinal extent of the basic body;

said anchoring portion having a first portion and a second portion formed from one piece, said second portion being positioned closer to said holding portion than said first portion along said longitudinal extent;

said first portion of said anchoring portion being cone shapes with a first cone angle;

said second portion of said anchoring portion being cone shaped with a second cone angle larger than said first cone angle;

threads attached to said anchoring portion for screwing the anchoring portion into the ground; and said anchoring portion and said holding portion being substantially hollow, wherein the anchoring portion is formed by hammering a cylindrica part into shape.

2. A device for fastening an object in the ground according to claim 1, wherein the threads extend substantially over an entire length of the anchoring portion.

3. A device for fastening an object in the ground, comprising:

a basic body including an anchoring portion extending from a first end of the basic body which penetrates the ground in use and a holding portion located adjacent a second end of the basic body;

at least a partial longitudinal extent of said anchoring portion being divided into a first conical portion having a first cone angle and a second conical portion having a second cone angle, said first and second conical portions both tapering in a direction towards said first end of the basic body, said first conical portion being closer to said first end than said second conical section;

said first cone angle of said first conical portion being smaller than said second cone angle of said second conical portion; and a thread attached externally to the basic body and extending at least along a portion of said first conical portion.

4. A device for fastening an object in the ground, comprising:

a basic body including an anchoring portion extending from first end of the basic body which penetrates the ground in use and a holding portion located adjacent a second end of the basic body;

at least a partial longitudinal extent of said anchoring portion being divided into a first conical portion having a first cone angle and a second conical portion having a second cone angle, said first and second conical portions both tapering in a direction towards said first end of the basic body, said first conical portion being closer to said first end than said second conical section;

said first cone angle of said first conical portion being smaller than said second cone angle of said second conical portion;

said basic body is hollow over a major portion of a length thereof; and a wall thickness of said basic body over said major portion increasing with a decrease in an outer diameter of the basic body.

5. A device according to claim 4, wherein said basic body is closed at said first end.

6. A device for fastening an object in the ground, comprising:

a basic body including an anchoring portion extending from a first end of the basic body which penetrates the ground in use and a holding portion located adjacent a second end of the basic body;

at least a partial longitudinal extent of said anchoring portion being divided into a first conical portion having a first cone angle and a second conical portion having a second cone angle, said first and second conical portions both tapering in a direction towards said first end of the basic body, said first conical portion being closer to said first end than said second conical section;

said first cone angle of said first conical portion being smaller than said second cone angle of said conical portion;

said basic body is hollow over a major portion of a length thereof including a hollow portion of said first conical portion; and said hollow portion of said first conical portion including a bore through a wall thereof.

* * * * *